US005175506A

United States Patent [19]

Parsons

[11] Patent Number: 5,175,506

[45] Date of Patent: Dec. 29, 1992

[54] VOLTAGE REGULATION IN LINEAR INDUCTION ACCELERATORS

[75] Inventor: William M. Parsons, Santa Fe, N. Mex.

[73] Assignee: United States Department of Energy, Washington, D.C.

[21] Appl. No.: 671,237

[22] Filed: Mar. 19, 1991

[51] Int. Cl.[5] ..... H05H 9/00

[52] U.S. Cl. ..... 328/233; 315/5.41

[58] Field of Search ..... 328/233, 227; 315/310, 315/5.41; 323/364, 369; 313/361.1

[56] References Cited

U.S. PATENT DOCUMENTS 4,583,025 4/1986 Adler et al. ..... 315/5.41

4,888,556 12/1989 Buttram et al. ..... 328/233

*Primary Examiner*—Donald J. Yusko

*Assistant Examiner*—Michael Horabik

*Attorney, Agent, or Firm*—Milton D. Wyrick; Paul D. Gaetjens; William R. Moser

[57] ABSTRACT

Improvement in voltage regulation in a Linear Induction Accelerator wherein a varistor, such as a metal oxide varistor, is placed in parallel with the beam accelerating cavity and the magnetic core. The non-linear properties of the varistor result in a more stable voltage across the beam accelerating cavity than with a conventional compensating resistance.

6 Claims, 2 Drawing Sheets

VOLTAGE REGULATION IN LINEAR INDUCTION ACCELERATORS

The invention is a result of a contract with the Department of Energy (Contract No. W-7405-ENG-36).

BACKGROUND OF THE INVENTION

The present invention relates to linear induction accelerators and, more particularly, to a method for improving voltage regulation in linear induction accelerators.

Linear induction accelerators are used in scientific research to produce high-current electron beams. In this use, it is normally a requirement that the beam be stable and focused. The ability to focus such a beam strongly depends on the constancy of the beam energy. Ripple and droop of the accelerator voltage pulses are the major causes of energy variation in electron beams produced by linear induction accelerators (LIAs), thus making focusing of the beam difficult. Voltage pulse ripple and droop are caused not only by imperfections in the pulsed-power source, but also by uneven beam loading and core magnetization current.

Conventionally, a compensation resistor is placed in parallel with the beam accelerating cavity of the LIA to attempt to minimize the effects of ripple and droop on the accelerator voltage. The value of the parallel resistance, relative to the beam impedance, determines the effectiveness of this method. However, precision applications, such as flash x-radiography, require resistance values much lower than the beam impedance. Unfortunately, this mismatch leads to very inefficient energy transfer between the pulsed-power system and the electron beam. Even with extensive resistive compensation, the pulsed-power system, the injector, and the magnetic section must be very carefully designed in order to achieve a beam energy variation of less than 1%.

The present invention solves these problems, and presents a solution in the form of a varistor. A metal oxide varistor exhibits extremely non-linear current-voltage behavior, allowing it to respond to non-uniformities in beam current.

It is therefore an object of the present invention to provide improved voltage regulation in linear induction accelerators.

It is another object of the present invention to provide an easily implemented regulation for an electron beam produced by a linear induction accelerator.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise, in a linear induction accelerator comprising a parallel combination of a beam accelerating cavity and an induction core, the improvement comprising a varistor connected in parallel with the magnetic core and the beam accelerating cavity. And a pulsed power source is input to the varistor.

In a further aspect of the present invention, and in accordance with its objects and purposes, a method of regulating voltage input to a linear induction accelerator wherein a beam accelerating cavity is connected in parallel with an induction core, comprising the steps of connecting a varistor to the parallel combination of said beam accelerating cavity and said induction core, and connecting a pulse power source to said varistor.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION

The present invention provides precise regulation of the acceleration voltage in a linear induction accelerator (LIA). Such regulation provides numerous benefits, among them, freedom from ripple in injected beam currents, minimization of overvoltages due to beam timing errors, and extension of pulse flattop due to steepening of rise and fall times. This is accomplished by use of metal oxide varistors in the power supplies used to power individual cells of a LIA.

Figure 1:
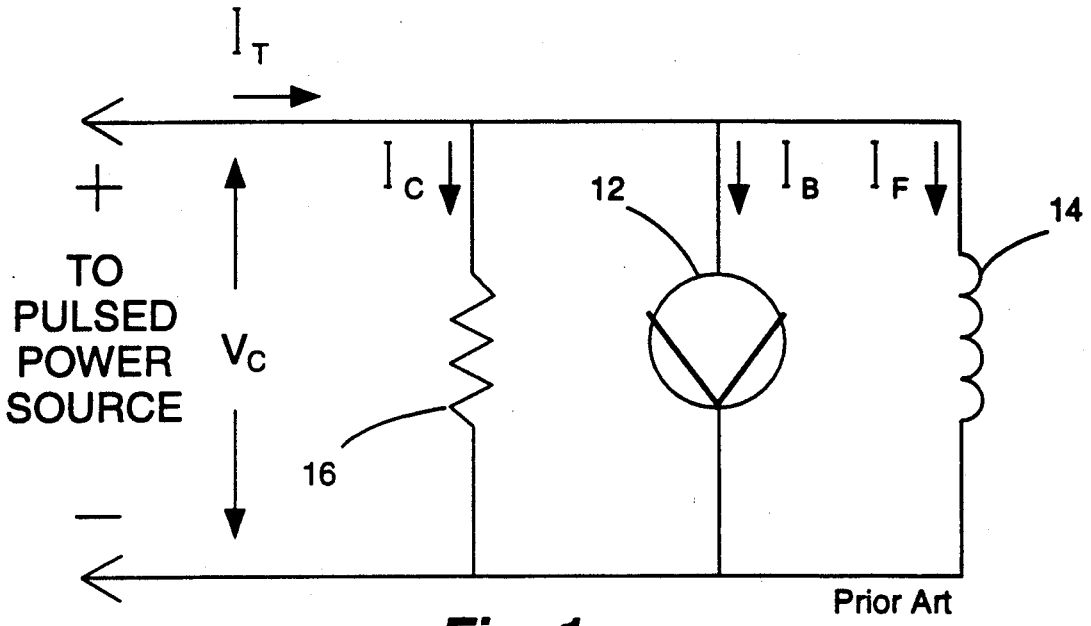
FIG. 1 is a schematic of the conventional power supply of an individual cell of a linear induction accelerator.

FIG. 1 illustrates a schematic of a conventional cell power supply where beam accelerating cavity 12, representing the current associated with the beam or electron injector or source of the LIA, and inductance 14, the induction core of the LIA, are connected in parallel with compensating resistance 16 and connected to a pulsed power source (not shown), such as a Pulse Forming Line (PFL) In this circuit as most pulsed power sources are current limited, current $I_T$ from the pulsed power source is equal to $I_C$, the current through compensating resistance 16, plus $I_B$, the beam current, and $I_F$, the current through inductance 14. With this circuit, problems arise because of imperfection in the pulses from the pulsed power source, as well as from non-uniformities of $I_B$ through beam accelerating cavity 12, and the induction current, $I_F$, through inductance 14, $I_F$. When either $I_B$ and/or $I_F$ vary, $I_C$, the current through compensation resistance 16, must also vary, because $I_T$ is fixed. This variation produces a variation in cell voltage, $V_C$, since $V_C$ is determined by the product $I_C \times R_C$.

This variation of cell voltage is extremely undesirable to the operation of the LIA, as it affects the energy spread of the final beam. The present invention greatly diminishes this deleterious effect.

Figure 2:
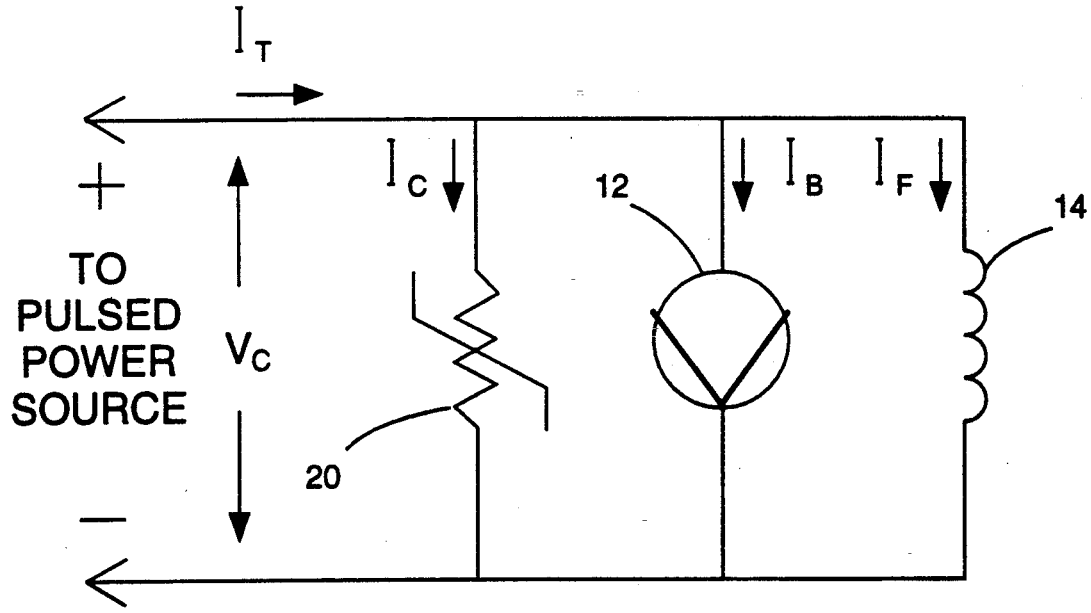
FIG. 2 is a schematic of the power supply of an individual cell of a linear induction accelerator with a varistor installed in parallel with the beam current and the induction core.

Reference should now be made to FIG. 2, where a schematic is illustrated which contains the improvement of the present invention. It can be readily seen in FIG. 2 that compensation resistance 16 (FIG. 1) has been replaced with varistor 20, which may be a metal oxide varistor, a non-linear device normally used by electrical utilities primarily as lightning arrestors and surge protectors. Varistors are manufactured by such companies as General Electric and Ohio Brass.

Although variations in $I_B$ and $I_F$ still draw upon $I_C$, the voltage drop across varistor 20 is much less sensitive to variations in $I_C$. This is because of the non-linear characteristics of varistor 20.

The actual varistor employed as varistor 20 in FIG. 2 may be a metal oxide varistor, such as a zinc-oxide (ZnO) varistor. The unique property of ZnO varistor material is its extremely non-linear current-voltage behavior. Information from one manufacturer, Ohio Brass, of Mansfield, Ohio, indicates that a typical varistor voltage increases by only 6% when the current through it is doubled from 5 to 10 kA. This data, however, applies to pulses in the 10 μs time regime.

The effect of varistor 20 in the circuit of FIG. 2 is that of a voltage regulator because of the above-described behavior under current fluctuations. By maintaining cell voltage within a reasonable tolerance, the quality of the beam from a LIA is greatly improved.

Tests were run using the apparatus of the present invention. In one test, a Blumlein pulse-forming line (PFL) with a 65 ns flat top output pulse was discharged into four parallel cables. Two of these cables were connected to a conventional compensating resistance 16 (FIG. 1), and the other two cables were connected to a varistor 20. Three voltage pulses were injected into compensating resistance 16, the pulses respectively having initial charges of 165 kV, 200 kV and 250 kV.

Figure 3:
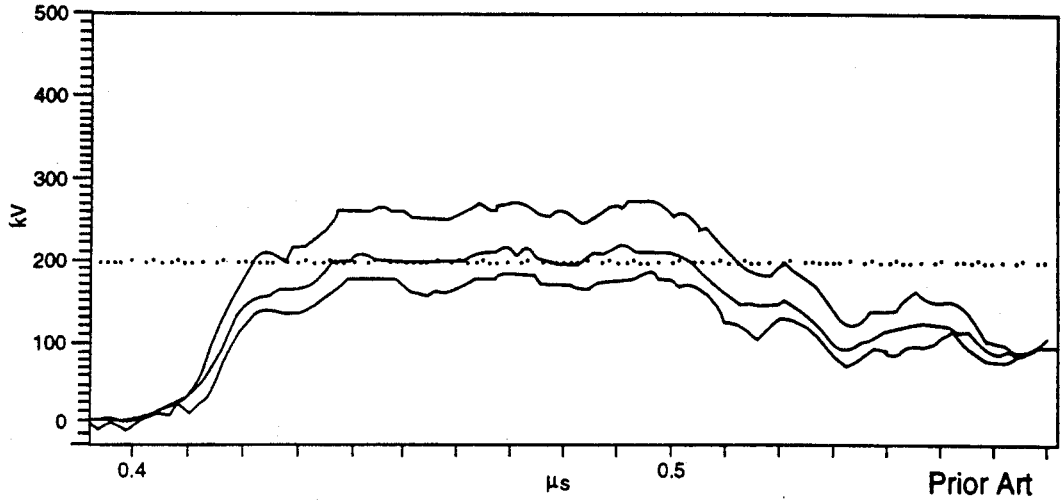
FIG. 3 is a plot of voltage versus time for a pulse into a resistive load.
Figure 4:
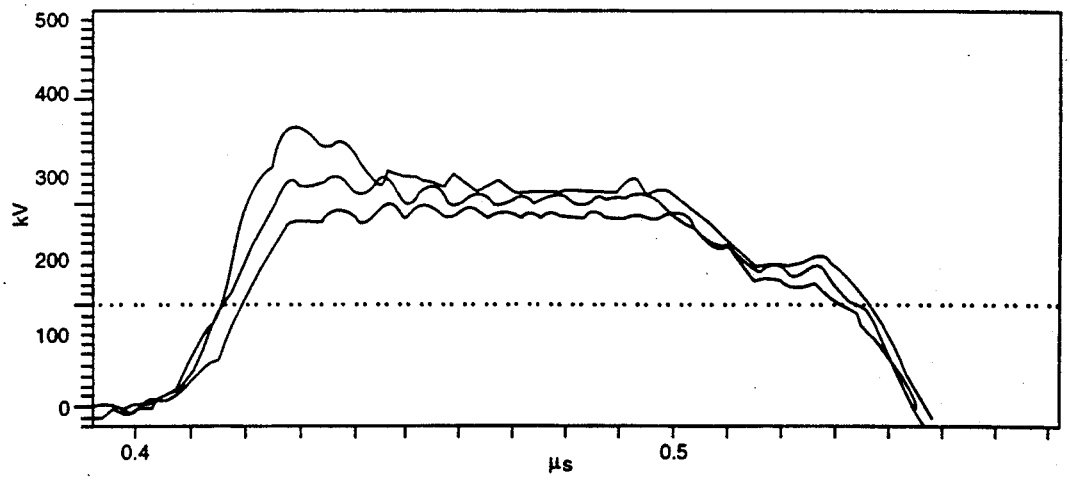
FIG. 4 is a plot of voltage versus time for a pulse into a varistor according to the present invention.

An overlay of the three pulses into compensating resistance 16 is illustrated in FIG. 3. As to be expected, the average voltage level of each of the three pulses corresponds to the initial charge voltage. FIG. 4 is an overlay of the same three pulses into varistor 20. It should be noted that a 50% increase in initial charge voltage from 165 kV to 250 kV produced only a 15% increase in voltage at varistor 20. With the initial charge voltage increased 25%, from 200 kV to 250 kV, a 6% voltage increase at varistor 20 was measured.

From this test, a theoretical factor of 500% improvement in regulation of cell voltage, $V_c$, appears to be achievable. It is also to be noted that, in addition to voltage regulation, the voltage risetime appreciably steepened, and the pulse flat top lengthened from 65 ns to 74 ns.

The use of varistor 20 brings other advantages. Among these are smoothing of the voltage flat top produced by the pulsed power source, insensitivity to variations in beam current, $I_B$, produced by the beam producing apparatus, and the fact that the cell voltage can be applied before the beam current begins, with no adverse affect on beam energy spread.

The foregoing description of the preferred embodiment of the invention have been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. In a linear induction accelerator comprising a parallel combination of a beam accelerating cavity and an induction core, the improvement comprising:

a varistor connected in parallel with said induction core and said beam accelerating cavity; and a pulsed power source input to said varistor.

2. The linear induction accelerator described in claim 1, wherein said varistor comprises a metal oxide varistor.

3. The linear induction accelerator described in claim 2, wherein said metal oxide varistor comprises a zinc oxide varistor.

4. A method of regulating voltage input to a linear induction accelerator wherein a beam accelerating cavity is connected in parallel with an induction core, comprising the steps of:

connecting a varistor to the parallel combination of said beam accelerating cavity and said induction core; and connecting a pulse power source to said varistor.

5. The method as described in claim 4, wherein said varistor comprises a metal oxide varistor.

6. The method as described in claim 5, wherein said metal oxide varistor comprises a zinc-oxide varistor.

* * * * *